US006520282B1

(12) United States Patent
Hadzic et al.

(10) Patent No.: US 6,520,282 B1
(45) Date of Patent: Feb. 18, 2003

(54) SOUND ENHANCEMENT MECHANISM FOR SPEAKER SOUND SYSTEM

(75) Inventors: Admir Hadzic, Montclaire, NJ (US); Junuz Hadzic, Gorazde (BA)

(73) Assignee: Nysora, Inc., Montclair, NJ (US)

( * ) Notice: Subject to any disclaimer, the term of this patent is extended or adjusted under 35 U.S.C. 154(b) by 14 days.

(21) Appl. No.: 09/695,555

(22) Filed: Oct. 24, 2000

(51) Int. Cl.[7] ..... A47B 81/06

(52) U.S. Cl. ..... 181/199; 181/155; 381/334; 381/325

(58) Field of Search ..... 181/199, 198, 181/30, 148, 155, 156, 160, 287; 381/90, 160, 205, 345, 349, 334, 335; D14/204, 210, 214

(56) References Cited

U.S. PATENT DOCUMENTS

| | | | | | |
|---|---|---|---|---|---|
| 2,231,235 | A | | 2/1941 | Weir | 206/13 |
| 2,577,528 | A | * | 12/1951 | Kennedy | 181/148 |
| 2,992,695 | A | | 7/1961 | Everitt | 181/31 |
| 3,032,137 | A | | 5/1962 | Rice | 181/31 |
| 3,151,699 | A | * | 10/1964 | Peavey | 181/156 |
| 3,443,661 | A | * | 5/1969 | Van Sciver | 181/199 |
| 3,727,719 | A | * | 4/1973 | Yando | 181/155 |
| 3,765,633 | A | * | 10/1973 | Caudill | 24/457 |
| 3,811,532 | A | * | 5/1974 | Everitt | 181/156 |
| 3,866,712 | A | | 2/1975 | Carruthers | 181/178 |
| 3,941,207 | A | | 3/1976 | Croup | 181/199 |
| 4,220,220 | A | * | 9/1980 | Ripple | 181/148 |
| 4,278,145 | A | * | 7/1981 | Eade et al. | 181/30 |
| 4,515,238 | A | | 5/1985 | Baker | 181/30 |
| 5,103,927 | A | * | 4/1992 | Heavener | 181/158 |
| 5,646,378 | A | | 7/1997 | Van Haaff et al. | 181/30 |
| 5,839,220 | A | * | 11/1998 | Wass | 43/100 |
| 5,979,591 | A | | 11/1999 | Harrison | 181/199 |
| 6,012,542 | A | * | 1/2000 | Accordino | 181/152 |
| 6,131,757 | A | * | 10/2000 | Clark et al. | 220/4.28 |

* cited by examiner

*Primary Examiner*—Robert E. Nappi
*Assistant Examiner*—Edgardo San Martin
(74) *Attorney, Agent, or Firm*—Fitch, Even, Tabin & Flannery

(57) ABSTRACT

A sound enhancement system is provided including a pre-existing system and a secondary enclosure with an internal space; wherein sound emanating from the loudspeaker system when the loudspeaker system is within the internal space, is enhanced (baffled) by the enclosure. The sound enhancement enclosure preferably is lightweight and collapsible. A method for enhancing sound is also provided including removably placing a loudspeaker system within an internal space of a sound enhancing enclosure. The invention provides a convenient, lightweight and inexpensive method for converting a preexisting loudspeaker system from an open-back design into a semi-closed or vented type, or from a close type of a small size into a larger-baffled size with resultant change in the quality of sound.

6 Claims, 10 Drawing Sheets

Fig. 9A
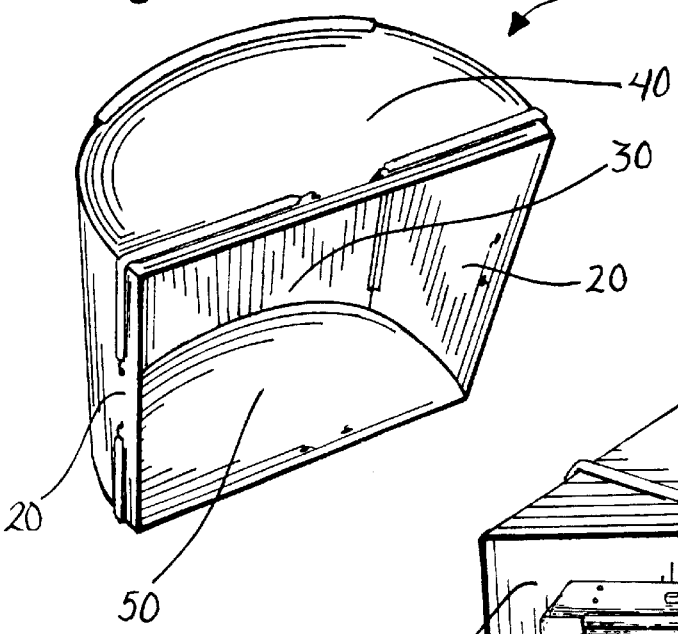
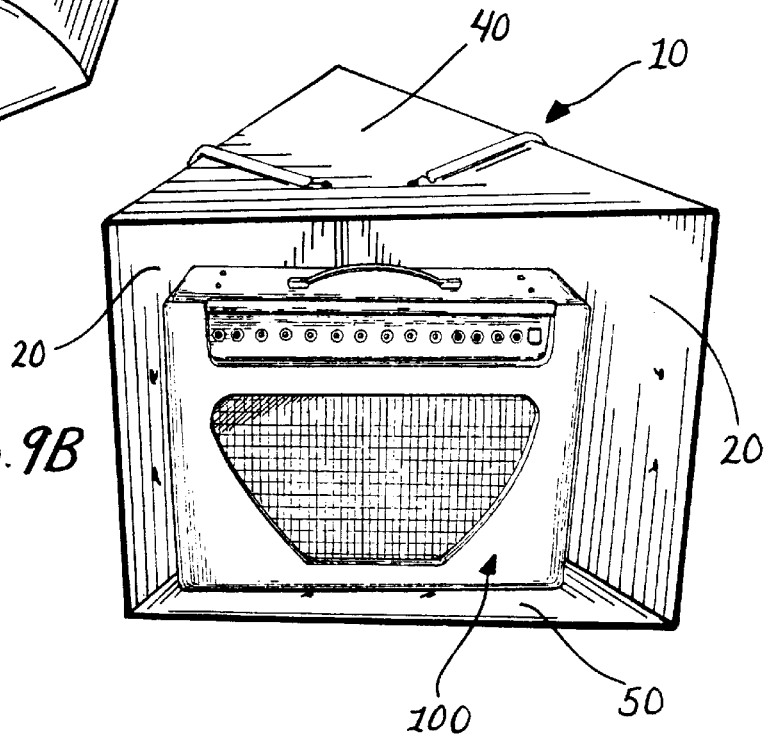
Fig. 9B
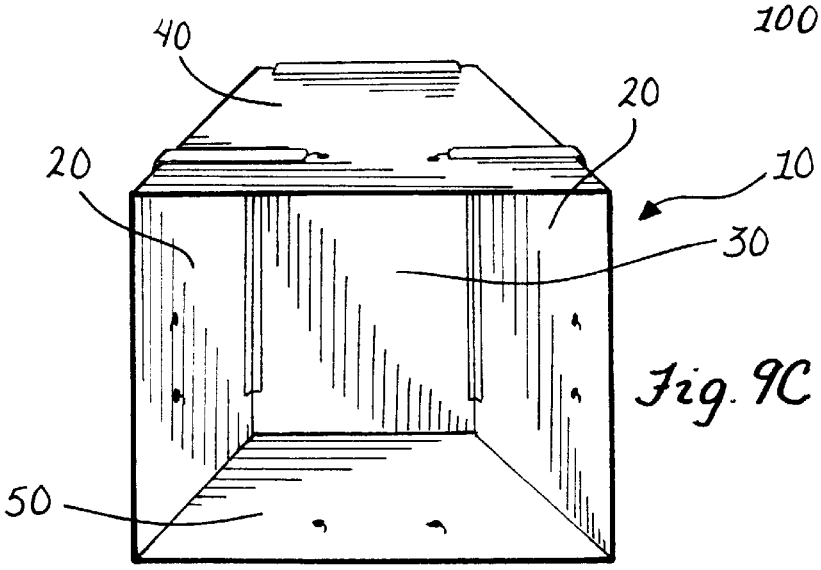
Fig. 9C

SOUND ENHANCEMENT MECHANISM FOR SPEAKER SOUND SYSTEM

FIELD OF THE INVENTION

This invention in general relates to sound enhancement systems and, in particular, to an inexpensive sound enhancement mechanism for use with commercially available guitar and other instrument amplification speaker systems.

BACKGROUND OF THE INVENTION

There are two fundamental amplifier-speaker formats:

1) the combo amp, where an amplifier and a speaker are combined in one cabinet; and
2) the stack, where the amplifier and speaker each have their own cabinet.

In the combo arrangement, the cabinet is usually open-backed. This is called a dipole speaker, because as much sound emanates from the rear of the speaker as from the front. Depending on the environment, some cancellation will occur between the front wave and the back wave. With lean tones, the number of component frequencies present at any given instant is low, so the number of cancellation is also low. With a distorted signal, many more frequency components are present at any one time, so both the number and intensity of cancellations is greater, which "muddies" the sound.

The sealed cabinet does not produce an external rear-wave. Sound emanates only from the front of the cabinet, directly from the speaker, so the only cancellations that can occur are caused by the room itself. These are in no way assisted by the speaker as in the dipole situation. The result is a tighter distortion tone. The sealed cabinet allows maximum power to be fed into the speaker, as the air inside the cabinet provides some acoustic dampening and support for the cone. It is important to note that combo amps with vacuum tube-type circuitry typically need the open back for ventilation.

Vented cabinets (sometimes called bass-reflex), will perform similarly to the sealed box, if the port is on the front baffle. All of the acoustical output is being blown forward, so cancellations are not too likely. Another advantage to the use of closed-back or vented cabinets, regardless of whether they are sealed or vented, is that they will perform more consistently from one environment to another.

The depth of sound of electrical guitar amplification systems is a very important characteristic. Various manufacturers of these systems commonly prize their guitar amplification systems ("amplifiers") as having "big, spacious, open sound" with a big "bottom end." While sound systems which can produce a spacious sound are readily available and easily built, they invariably have a number of drawbacks inherent with speaker systems capable of delivering a "spacious" or "big" sound. For instance, guitar amplifier-speaker systems that are most prized for the spaciousness and depth or richness of the sound are usually combinations of a guitar amplifier and separate, larger loudspeaker enclosures (cabinets). This is because the typical cone-type speaker systems using a vibrating diaphragm cone are generally enclosed in a cabinet to contain the sound pressure radiated behind the diaphragm so that it does not negatively interfere with the sound generated in front of the diaphragm and out from the cabinet. This results in a sound enhancement which is typically described as "fuller", "tighter", and better "focused". Generally, the cabinet is designed for maximum internal volume and it is based on characteristics of the loudspeaker diaphragm to obtain the desired "fullness" or "enhanced lower-end response" of sound at lower frequencies.

Examples of these bigger systems are made by many renowned manufacturers, such as Marshall®, Peavy®, Laney®, etc. However, these systems capable of producing a "bigger sound" are usually heavy, bulky, and expensive. Thus, while these systems are generally superior for concert performances, they are highly impractical as quick, carry on, practice or recording amplifiers. Of note, the vast majority of users of these amplifier systems are guitar or other instrument players who do not perform in public. Thus storage, bulkiness and cost of these big amplification-speaker systems is burdening or impractical. In addition, in order to achieve a good sound in an electrical-guitar speaker system, one usually needs to turn the volume up, which results in a sound of very high and inconvenient levels, potentially causing hearing damage, as well as family and neighbor concerns. In contrast, smaller systems have less power and do not reach inconvenient volume levels. However, these smaller systems often lack the fullness, resonance and depth of the larger speaker systems.

The market is flooded with substantially smaller, lighter and inexpensive guitar amplification systems with both the amplifier and the speaker(s) fitted in an easily portable enclosure. As with large speaker cabinets, the speakers are mounted in an opening formed in a front wall of their cabinet. The amplifier unit containing circuitry for driving the speaker, typically is mounted below or above the speaker with the controls therefor accessible through the cabinet wall. These guitar amplifier-speaker systems are known as "combos." Compared to the larger amplifier-speaker systems, these are light, substantially smaller systems. Unfortunately, these small combos almost universally suffer from the lack of "spaciousness," or "bottom end," due largely to the use of smaller size speakers and loudspeaker enclosures. It is known that improved fullness of sound can be obtained in these combo units by either a duct in the cabinet or use of insulation or other absorptive materials on the inner surface of the cabinet walls, or some combination of these features. However, larger cabinets are undesirable as they can become too cumbersome or bulky to be easily lifted and carried or transported in a vehicle. Thus, smaller amplifier-speaker systems have an inherent compromise in their sound quality or depth due to their lightweight, portable and overall small-dimension design. Therefore, there remains a need for an apparatus or method for improving the fullness, resonance and depth of the above-mentioned smaller, portable speaker systems.

In general, the ability of the combo or any amplifier-speaker system to produce lower frequencies (e.g. 70 Hz to 200 Hz) adds a certain dimension to the sound, which is highly prized in guitar or other instrument amplification systems. While the modern amplifier designs are almost universally capable of delivering the whole frequency spectrum required for guitar amplification, unfortunately it is usually the size of the speakers and their cabinets in which they are mounted that largely determine the "bottom end" or the "spaciousness" of the sound. This is especially a problem when playing at low sound pressures (volumes).

Thus, in summary:

Small amplifier-speaker systems (combos):

Easy portability/transport

Inexpensive

Light weight

Highly practical for carry-on, jamming, gigging, etc.

"Thin" sounding, lack of "bottom end" or "depths"

Large amplifier-speaker systems (combos and separate amplifier-speaker cabinet systems)

Bulky

Heavy

Expensive

Less practical for carry-on, jamming, gigging, etc.

"richer," fuller, more spacious ("bigger") tone

It is estimated that the vast majority of amplifier-speaker systems sold today are of the smaller size. These are used primarily in private homes for practicing, light jamming, and entertainment. While these amplifier-speaker systems are conveniently sized for transport, placement and storage, their small size also presents a clear disadvantage in quality of the sound reproduction. This disadvantage is in the form of a limitation of the range, depth, fullness and balance of tone that can be achieved with their small cabinet speaker size. Thus, there is a compromise between the speaker design, economics, ergonomics and quality of sound.

Virtually all combo amplifiers made today are either of open back or closed types. Some are equipped with a removable back panel which enables one to convert an open-back model to a closed-back model. However, even then, these combo amplifiers are confined to the volume of the cabinet. This is an obvious disadvantage for the small amplifier design as it is well known that larger cabinets yield a fuller sound at any volume level than do small speakers and small boxes.

Thus, there is a need for methods and apparatuses for conveniently and quickly enhancing the sound of these systems without adding bulkiness, weight or a significant expense.

SUMMARY OF THE INVENTION

In accordance with the present invention, a system is provided that includes a low cost mechanism to improve sound quality of small guitar (or other instrument) amplification-speaker systems in terms of its "depth of sound" or "fullness" as previously described from commercially-available so-called "combo" amplifier-speaker units. To this end, the system does not require structural, or other costly modifications to these combo units, allowing them to retain their light-weight character and providing a mechanism that an owner can purchase to retrofit to combos that they already own at a substantial savings over purchasing a more expensive, larger and/or heavier combo unit. More particularly, the present system provides a secondary enclosure that is sized to fit over a commercially available combo unit with a predetermined amount of spacing between it and the primary enclosure of the combo unit based on the desired enhancement of sound therefrom. The combo unit and the said enclosure are combined to conveniently and effectively convert an open back combo unit into a semi-closed back or a vented speaker cabinet unit of a larger proportion and achieve a wide array of sounds otherwise available only using a dedicated closed or vented speaker cabinets. Accordingly, the current invention meets these needs by enhancing the sound of a small speaker system without adding significant cost or weight or compromising portability of the amplifier-speaker systems.

As is apparent, the secondary enclosure can be made to be relatively lightweight and preferably has walls that can be folded such as onto each other so that the enclosure can be reduced to a compact, transport form that, similar to the combo unit, is lightweight so that it can easily be moved from one location to the next. Manifestly, although the invention is described with respect to use with guitar (and other instrument) combo units, it will be recognized that the system described herein can be used with other sound systems including a primary enclosure thereof with which a user would like improved depth or fullness of sound emanating therefrom. Some examples of this may include enhancement of a portable CD-cassette players, transistor radios and the like.

In one form of the invention, a sound enhancement system is provided including a sound enhancement enclosure and a loudspeaker system, wherein the loudspeaker or amplifier-loudspeaker system is removably disposed within the sound enhancement enclosure. In a preferred form, the sound enhancement enclosure is light-weight and collapsible. Another aspect of the current invention is a method for enhancing sound including removably placing a preexisting loudspeaker system within a sound enhancement enclosure at a performance location.

BRIEF DESCRIPTION OF THE DRAWINGS

FIG. 9 panel A is a front perspective view of a sound-enhancement mechanism in accordance with the present invention showing an oval enclosure in its unfolded state. Panel B is a front perspective view of the instrument amplifier-speaker system placed in a triangular sound-enhancement enclosure to form the sound enhancement system in accordance with the present invention. Panel C is a front perspective view of a sound-enhancement mechanism in accordance with the present invention showing in its unfolded state, an enclosure with non-parallel side walls.

DETAILED DESCRIPTION OF THE PREFERRED EMBODIMENT

Figure 5:
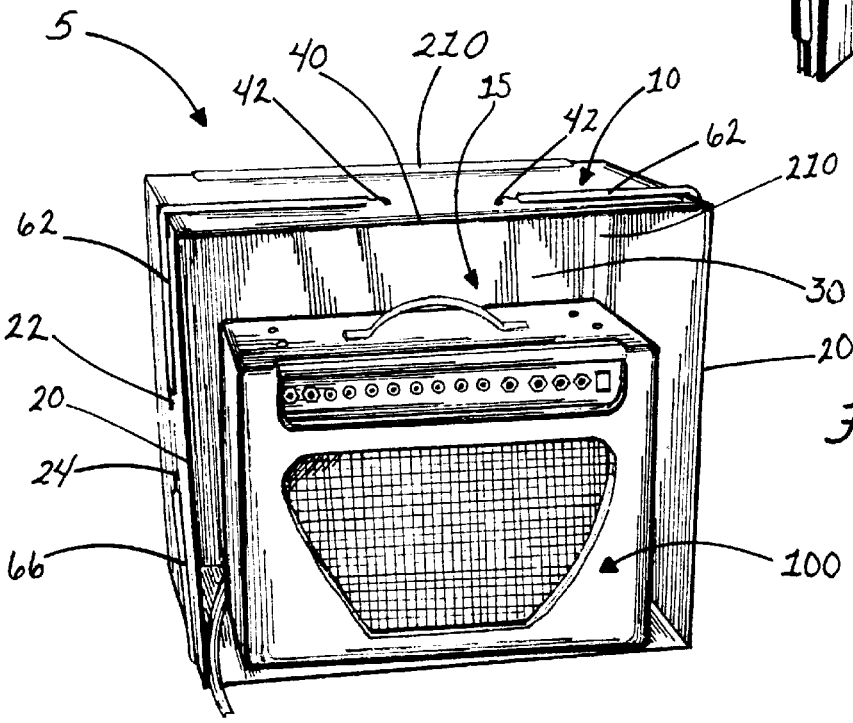
FIG. 5 is a front perspective view of the instrument amplifier-speaker system placed in the sound-enhancement enclosure to form the sound enhancement system in accordance with the present invention.

The present invention is a sound system 5 that allows a user to enhance sound that emanates from a preexisting or commercially-available guitar (and other instruments) combo-amplifier loudspeaker system 100 via use of a sound enhancement mechanism 10, as shown in FIG. 5. In this manner, the owner can inexpensively convert their system 100 to the sound system 5 of the present invention to obtain sound quality therefrom that would otherwise only be available by purchase of a new and probably more expensive and heavier or bulkier system. In addition, the sound enhancement mechanism in the form of a secondary enclosure 10 as will be described more fully hereinafter, allows the owner to easily retrofit their already purchased preexisting system 100 to the present system for obtaining the desired improvement in sound quality therefrom without requiring any expensive or difficult to implement modifications to the preexisting system 100.

As mentioned, the sound enhancement mechanism takes on the form of secondary enclosure 10 into which the loudspeaker system 100 is placed. To this end, it has been found that the sound quality improvement obtained by the system 5 can be adjustably controlled by changing the distance or space 15 between the enclosure 10 and the loudspeaker system 100. In other words, the sound quality will change as the spacing 15 changes. More specifically, the enclosure 10 and the loudspeaker system 100 will generally have corresponding or facing walls, e.g. side walls, rear wall, top wall, which depending on the position of the system 100 within the enclosure 10 will have a selected spacing 15. As this spacing 15 can readily be changed by simply repositioning the loudspeaker system 100 in the enclosure 10, the musician can easily adjust the sound quality they are obtaining from the present system 10 until they obtain their desired sound quality. Although the spacing can be changed, to obtain enhanced sound using the sound enclosure the loudspeaker system 100 is positioned so that the back of the speaker 120 faces one of the walls of the enclosure 10, typically the rear wall 30.

For the present invention, the sound quality or characteristic includes fullness (depth), especially as it pertains to lower-end response, that is, sound pressure response in decibels (dB) below 200 Hertz (Hz), as a typical low-end frequency response of the guitar and similar instruments is 70 Hz to 200 Hz. The sound pressure response is a frequency dependence of sound pressure level (in db) measured in an anechoic (or outdoors) chamber at 3.3 ft (1 m) from the loudspeaker (on axis) when a sinusoidal electrical input of 1 W is applied.

The secondary enclosure of the current invention enhances sound from the loudspeaker by enhancing the low-end response. That is, a second predetermined quality characteristic has enhanced low end response compared to a first predetermined quality characteristic. By "enhanced low-end response" is meant increased sound pressure levels at frequencies below 200 Hz.

Not to be limited by theory, it is believed that the secondary enclosure 10 of the sound enhancement system enhances sound from the loudspeaker by acting as a baffle and by directing (reflecting) the sound of low frequencies (i.e. below 200 Hz) out of the secondary enclosure opening. Loudspeakers have omnidirectional characteristics in the low-frequency region, where the wavelength is much larger than the diameter of the loudspeaker. Since small, lightweight combo-type amplifier-speaker systems contain loudspeakers with relatively small diameters, omnidirectionality of produced sound at low-end frequencies occurs at a frequency range including higher frequencies than occurs in larger speaker systems. Therefore, with small amplifier-speaker systems, low-end frequency sound pressure levels are relatively low because low-end sound are is effectively directed or baffled. A properly baffled speaker can produce up to 100 times greater sound intensity at lower frequencies than it can in the free air. It is this inadequately baffled speaker's ability in lower frequency performance that makes its sound thin and unbalanced. Thus, the purpose of the secondary enclosure (i.e. the sound enhancement enclosure) is to baffle the speaker, and amplify and direct low-end frequencies out the secondary enclosure opening, toward a listener, thereby enhancing the low-end response of the sound emanating from the enclosure as compared to the sound when it emanated from the loudspeaker.

Furthermore, it is believed that the sound enhancement system enhances sound by reducing pressure cancellation that can occur at low frequencies. When the diaphragm of a loudspeaker vibrates in free space, cancellation at low frequencies occurs of sound pressure produced in front of and behind the speaker. The secondary enclosure of the current invention may enhance low-end frequency response by reducing this cancellation at low frequencies by containing pressure radiated behind the speaker.

Figure 6:
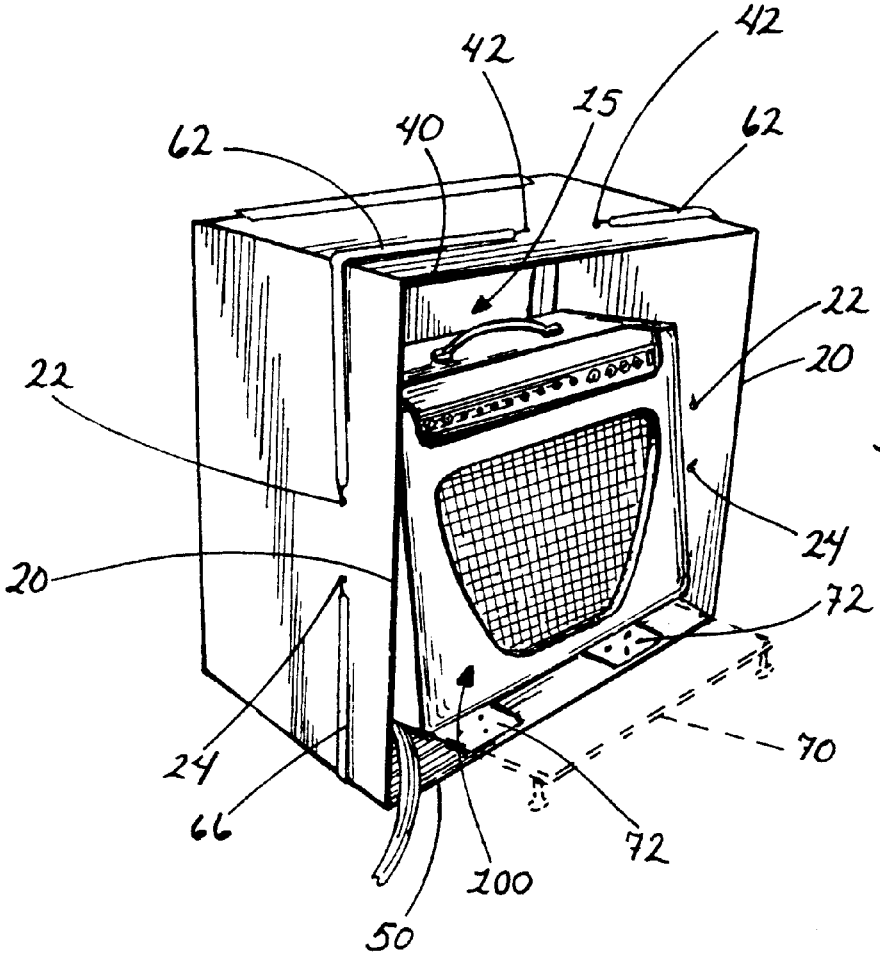
FIG. 6 is a side perspective view of an embodiment of the sound enhancement system with an instrument amplifier-speaker system (combo guitar amplifier) in a transportable sound-enhancement enclosure. The enclosure presented here also incorporates a redirection system (arrows) which allows tilting of the amplifier speaker system and thus additional adjustments.

As previously described, the sound enhancement system can be tuned to a frequency range of desire by changing the size of the secondary enclosure 10 and/or position of the loudspeaker system 100 within the secondary enclosure 10 (FIGS. 5 and 6). The ability to tune the sound enhancement system is the result of the ability of the secondary enclosure to direct low-end sound waves of different frequencies depending on the distance and angle of the plurality of walls of the secondary enclosure to the plurality of walls of the primary enclosure.

Figure 4:
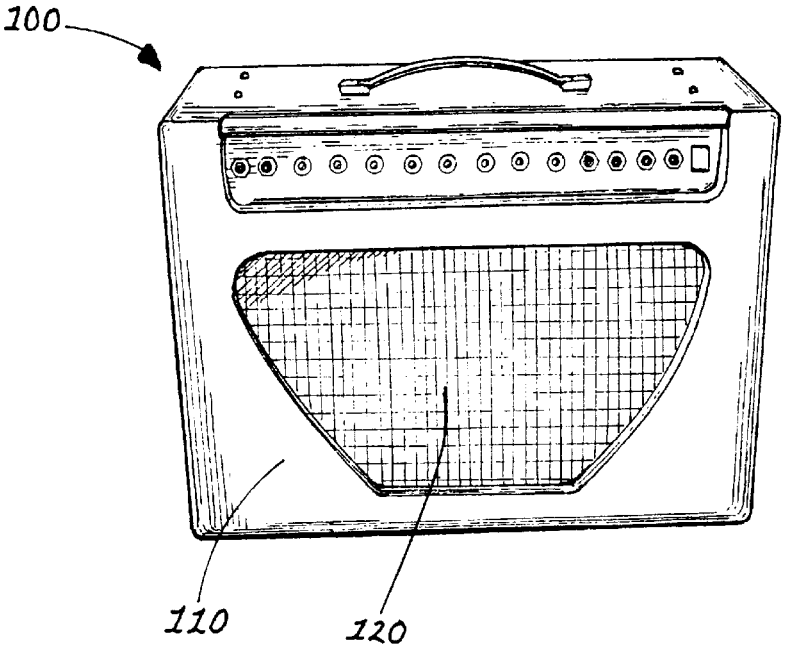
FIG. 4 is a front perspective view of an instrument amplifier-speaker system.
Figure 7:
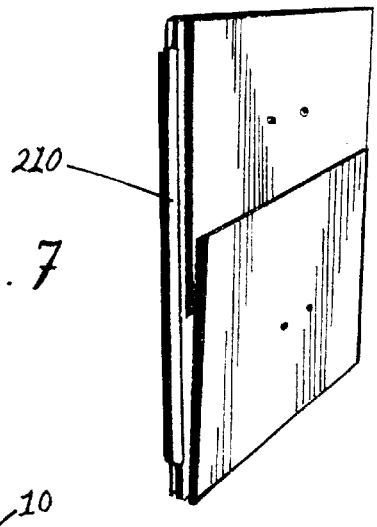
FIG. 7 is a perspective view of a sound-enhancement enclosure in a partially folded configuration.

It is envisioned that the present system 5 will be most suited for retrofitting relatively small size combo units 100 that musicians currently own and from which they would like improved sound quality in terms of low-end response as described above. In these combo units 100, the cabinet 110 (FIG. 4) is usually of a small size so as to be readily transportable and little or no sound insulation material is used therewith to keep them lightweight for transport. Thus, although the system 5 can be adapted with other types of sound systems, it is contemplated that it will find its major appeal to those who own combo units 100 and who desire richer, fuller low-end tones than their unit 100 can currently provide. The system will also be useful for easy conversion from an "open back" sound quality to a "closed back" sound quality, depending on the style of music played and quality of sound desired.

Figure 1:
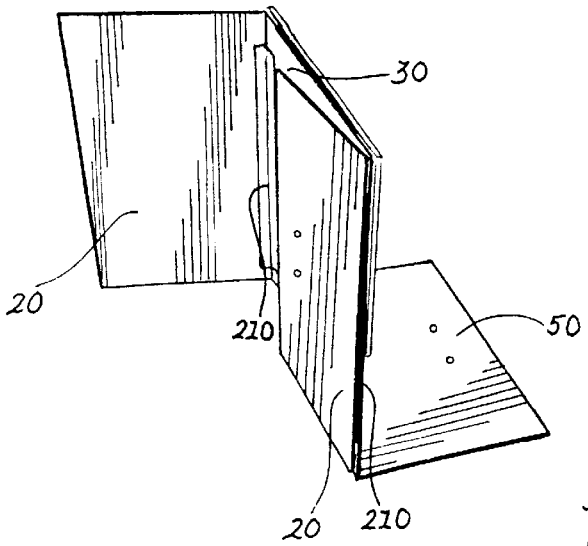
FIG. 1 is a perspective view of a sound-enhancement mechanism in accordance with the present invention showing an enclosure including a plurality of foldable walls in the process of being unfolded from its folded, transport state.
Figure 2:
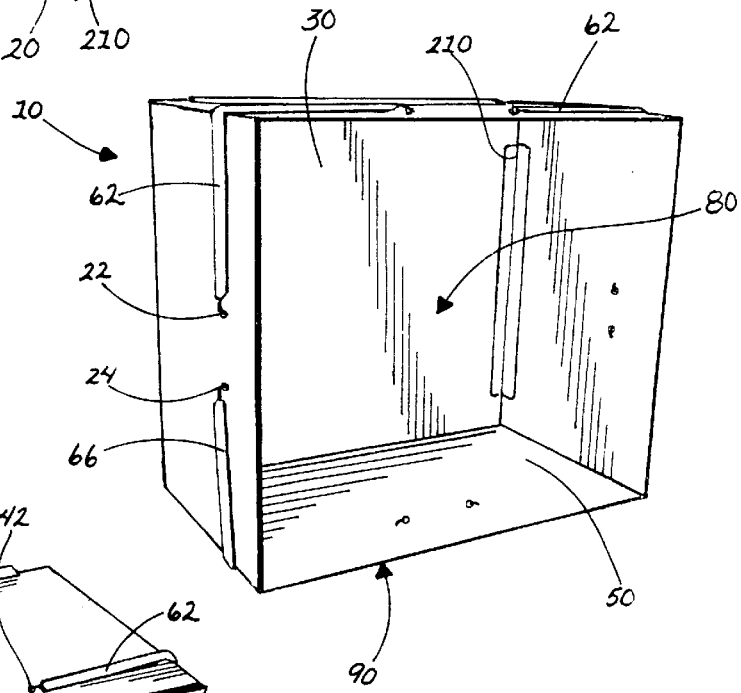
FIG. 2 is a front perspective view of the mechanism of FIG. 1 showing the enclosure in its unfolded, operable state.
Figure 3:
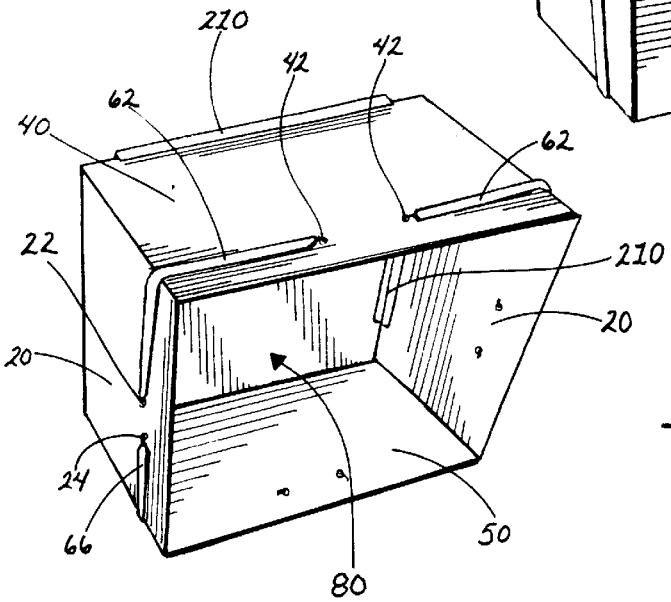
FIG. 3 is a top perspective view of the mechanism of FIG. 1 showing the enclosure in its unfolded, operable state.

In the illustrated and preferred form, the secondary enclosure 10 of the sound enhancement system of the current invention includes a plurality of walls that define an internal space that is larger than the primary enclosure. Typically, the secondary enclosure contains a plurality of side panels 20, 30 arranged substantially upright, a top panel 40, an opening 90, and the panels are constructed of a small-enough size and light material so that the enclosure is transportable, as can be seen in FIGS. 2 and 3. The secondary enclosure 10 is preferably made of rigid material such as plastic, composite, plexiglas, particle board, and, the like, that is light weight yet capable of deflecting and reverberating sound. To be transportable the enclosure 10 is preferably small and light enough to be easily carried by one person and coimpactly stored when not in use.

As can be seen in FIGS. 5 and 6, secondary enclosure walls define space that is larger than the primary enclosure. Therefore, the walls of the secondary enclosure are typically at least 1–2 feet taller, 1–2 feet wider, and 1–2 feet deeper than that of the primary amplifier-speaker (combo) to be placed within.

Figure 8:
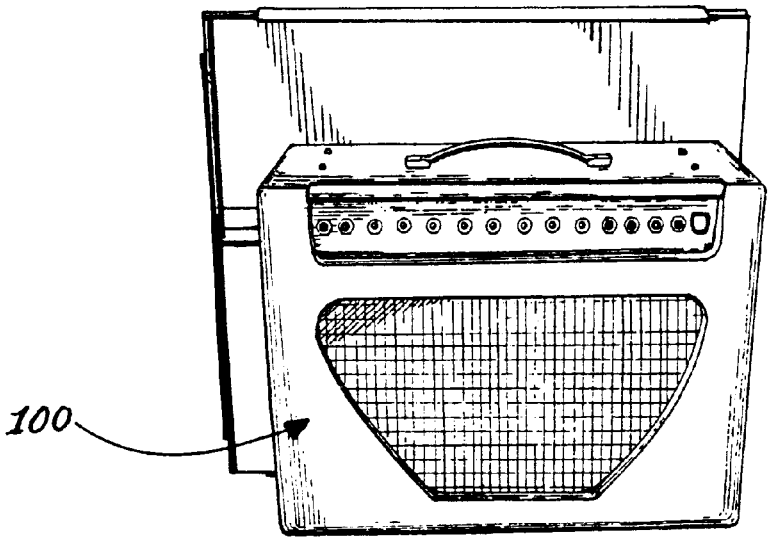
FIG. 8 is a perspective view of a sound-enhancement enclosure folded in preparation for transport, folded and fastened to an amplifier for easy transport. The sound enhancement enclosure can alternatively be folded in a lightweight, carry-on style case.

In one preferred form, as can be seen in FIG. 8, the secondary enclosure 10 is collapsible into a folded state. Although it is contemplated that the secondary enclosure 10 may be collapsed in any number of manners, in a preferred form, fold lines are provided at predetermined sections between adjacent walls of the enclosure. Alternatively, the secondary enclosure may be collapsed by disassembly or by folding along hinges that connect adjacent walls. As shown in FIG. 8, the secondary enclosure 10 when it is in a folded position may be attached to the loudspeaker system 100.

Referring next to FIGS. 1–3, 7 and 8, the sound enhancement mechanism or enclosure 10, is capable of being opened from a folded configuration (as shown in FIG. 8) to an unfolded operable state or configuration (as shown in FIGS. 2–3).

The sound enhancement enclosure has a plurality of walls and a secondary enclosure opening 90, wherein the plurality of walls define an internal space 80. The number and positioning of side walls may be varied as long as the enclosure is capable of enhancing the sound quality or characteristic emanating from a preexisting loudspeaker system located in the internal space 80 of the enclosure. The plurality of walls may include side walls 20, preferably two side walls 20, a rear wall 30, and a top wall 40. Preferably, the plurality of walls includes a bottom wall 50.

In certain embodiments, a structure external to the enclosure may be used as, or instead of, a wall of the enclosure. For example, rather than have a separate bottom wall 50, the enclosure 10 may instead use the floor of a performance location as the bottom wall 50. Alternatively, or in addition, rather than have separate side walls 20, the enclosure 10 may instead use vertical walls located at a performance location which may serve a function other than sound enhancement, as the side walls 20. For example, one or more vertical walls of a room or a stage at a performance location may be used as, or in place of, the side walls 20 by resting the enclosure 10 against the one or more vertical walls.

Referring to FIGS. 1–3 and 7, each of the side walls 20, the top wall 40, and the bottom wall 50, when it is present, is rotatably or otherwise foldably connected at a rear edge 210 to the rear wall such that they are capable of folding along the axis formed by the rear edge 210 to bring a surface of each the side walls 20, the top wall 40, and the bottom wall 50 wall into close proximity to a surface of the rear wall. When walls are folded along their rear edges 210, the enclosure is in a folded configuration as depicted in FIG. 8. In the folded configuration, the walls of the enclosure are stacked on top of one another.

The side walls 20, the top wall 40, and the bottom wall 50 are in "close proximity" to the rear wall when they are stacked on top of the rear wall such that one surface of each of the side walls 20, the top wall 40, and the bottom wall 50 makes contact with the rear wall, or when the angle along a rear edge 210 between the rear wall and each of the side walls 20, the top wall 40, and the bottom wall 50 is between about 10° and −10°.

By "rotatably connected" is meant that walls can be rotated along an axis created by the edges of rotatably connected walls. Many different means for creating rotatable connections are known and can be used for the current invention. For example, a flexible cover, such as a vinyl cover, can be placed over connected walls, wherein the walls are rigid inserts in the vinyl, and the walls are free to rotate about the axis formed between the walls, while being held together by the vinyl cover. Preferably, the rotatable connection is created by a hinge that is attached to two rotatably connected walls.

The secondary enclosure opening 80 is formed typically opposite the rear wall 30 by front edges of each of the side walls 20, the top wall 40, and the bottom wall 50.

The secondary enclosure of the current invention further comprises a securing assembly that holds the collapsible enclosure in an assembled position and reduces vibration of the walls when sound makes contact with the walls. There exist many possible types of securing assemblies well known in the art for holding a collapsible enclosure in an assembled position. A preferred securing assembly of the current invention is a strap assembly comprising two upper straps 62 and a lower strap 66. The strap assembly holds the collapsible enclosure in an assembled position when the strap assembly is in a secured position.

Many different types of straps are known in the art and can be used with the current invention. Preferably, the straps are resilient and capable of being stretched such that tension can be created between the ends of the strap. For example, straps may be made of rubber or vinyl. Alternatively, the straps may be strings or springs.

FIGS. 2–3, depict one preferred embodiment for bringing a strap assembly into a secured position. In this embodiment, each side wall has an upper side wall strap anchor 22 and a lower side wall strap anchor 24, and the top wall has two top wall strap anchors 42.

To achieve a secured position, the two upper straps 62 are anchored at a top wall strap anchor and disposed along the outer top wall surface toward opposing side walls, typically toward the side wall closest to the top wall, and are anchored to an upper side wall anchor. The lower strap 66 is anchored to the two lower side wall strap anchors 24 when it is secured to hold the enclosure in an assembled position. The lower strap 66 is disposed along the outer surfaces of the side walls below the lower side wall strap anchor 24 and is extended along the bottom of the enclosure. In embodiments in which the bottom wall is present, the lower strap is extended over the outside surface of the bottom wall.

Wall strap anchors can be any structure capable of securing a strap to a wall. The wall strap anchors can be holes in the walls, through which rigid ends of the straps can be threaded and then opened so as to stop the end from threading back through the hole when there is tension on the strap. Alternatively, where the wall strap anchors are holes in the walls, a strap can be secured to the wall strap anchors by hooks at the ends of the straps. In a preferred embodiment, the strap anchors are velcro® strip anchors, wherein strap ends contain a velcro® strip capable of annealing to the velcro® strip anchors.

When the sound-enhancement enclosure is no longer desired, such as when a different sound is sought or for transport purposes, the enclosure is easily disassembled (FIGS. 7 and 8) and either stored or fastened to the loudspeaker system 100 for transport (FIG. 9). The sound enhancement enclosure may also have a handle built in or attached to facilitate transport.

Once the enclosure 10 is assembled (FIGS. 2 and 3), a loudspeaker system 100 (FIG. 4) can be placed inside the speaker enclosure 10 (FIG. 5) to enhance its sound by accentuating and enhancing the lower frequency spectrum.

The secondary enclosure may include a fan for cooling the loudspeaker system 100 placed inside the enclosure. In yet another embodiment the secondary enclosure further comprises an electrical outlet to provide power for an amplifier-speaker system positioned inside the secondary enclosure, or to provide power for any additional electrical devices that may be used with the secondary enclosure such as the above-described fan.

As illustrated in FIG. 8, the secondary enclosure 10 in its folded position can be connected to the loudspeaker system and transported in this folded position together with the loudspeaker system 100. Any connection means known in the art for reversibly connecting surfaces can be used. For example, the connecting means can be complimentary velcro® strips.

Sound Enhancement System

Reference will now be made again to FIGS. 5–6 for generally describing the sound enhancement system 5 in accordance with the present invention. The sound enhancement system includes a preexisting loudspeaker system 100 including a primary enclosure 110 for containing a speaker 120 from which sound having a first predetermined quality or characteristic emanates therefrom. The sound enhancement system further comprises a transportable secondary enclosure 10 including a plurality of secondary enclosure walls 20, 30, 40, 50 defining an internal space 80 that is larger than the primary enclosure 110 to allow a user to place the preexisting loudspeaker system 100 within the internal space 80 of the secondary enclosure 10. The sound having a first predetermined quality or characteristic is enhanced by the secondary enclosure to form a sound having a predetermined quality or characteristic different from the first predetermined quality or characteristic by a desired predetermined amount.

The loudspeaker system 100 is positioned within the secondary enclosure 10 to direct sound having a second predetermined quality or characteristic out of a secondary enclosure opening 90 towards a listener.

The preexisting loudspeaker system 100 is removably disposed within the secondary enclosure 10. By "removably disposed" is meant that the loudspeaker system 100 can be easily positioned within the secondary enclosure 10 at a performance location, and easily removed from within the secondary enclosure 10 for storage or in preparation for transport.

After the loudspeaker system 100 is placed inside the secondary enclosure 10 it can be secured to the enclosure with a fastener 62, 66, such as, but not limited to, a velcro or rubber strap. Preferably, the loudspeaker system 100 is freely positionable within the secondary enclosure 10. By "freely positionable" is meant that the loudspeaker system 100 can be placed anywhere inside the secondary enclosure 10 when the sound enhancement system is set up to enhance sound at a performance location. Alternatively, the loudspeaker system 100 can be secured at any one of a plurality of securing sites located within the enclosure.

By "performance location" is meant a site where the sound enhancement system will be used to enhance sound from the loudspeaker system 100. Preferred performance locations for the present invention include locations in personal residences such as bedrooms, basements, or garages. Other performance locations include, but are not limited to, concert halls, gymnasiums, lounges, and stadiums.

Preferably, the loudspeaker system 100 is a light-weight guitar amplifier. Most preferably, the loudspeaker system 100 is a combo. A "combo" is a relatively small, light-weight, and inexpensive guitar amplification systems with both the amplifier and the speaker(s) fitted in an easily portable enclosure. Combo amplifiers are manufactured by many companies and are currently widely available at retail outlets which sell guitar amplification equipment. Although a small, combo type amplifier is preferred, virtually any loudspeaker system 100 can be used with the current invention, provided that it contains a speaker mounted in a primary enclosure, ie. a speaker cabinet, and is smaller than the opening in the secondary enclosure.

Typically, the sound source amplified by the loudspeaker system is an electic guitar. However, any sound source can be amplified by the loudspeaker system 100 for the current invention. For example, the sound source could be a brass instrument, a human voice, a saxophone, or any other musical instrument.

As exemplified in FIG. 6, the secondary enclosure 10 can include a redirection panel 70 used to angle or redirect sound in a desired direction, where the sound originates from a loudspeaker system 100 positioned within the secondary enclosure. The redirection panel may include a hinge-type attachment 72.

The redirection panel 70 is incorporated close to the enclosure opening 80 and is attached, preferably rotatably attached, to the secondary enclosure at extension panel attachment sites 72. For example, hinge-type attachments support structures, such as a post when the panel is angled in an upward direction and extends out from the bottom panel, well known in the art are used to hold the extension panel at a desired angle.

Referring now to FIG. 9, the sound enhancement enclosure 10 may take alternative shapes as long as a loudspeaker system 100 is freely positionable therein, and as long as the plurality of secondary enclosure walls 20, 30, 40, 50 can be arranged into an enclosure 10 so as to enhance the sound quality or characteristic emanating from the loudspeaker system 100.

Method for Enhancing Sound

Another aspect of the current invention is a method for enhancing the sound of a loudspeaker system 100. The method involves first, providing a preexisting loudspeaker system including a primary enclosure for containing a speaker, and a secondary enclosure including a plurality of secondary enclosure walls defining an internal space that is larger than the primary enclosure. Second, positioning to a first position, the preexisting loudspeaker system within the internal space of the secondary enclosure. The positioning step typically occurs at a performance location. Third, projecting sound with a first predetermined quality or characteristic from the loudspeaker system, wherein an enhanced sound having a second predetermined quality or characteristic different from the first predetermined quality or characteristic by a desired predetermined amount, emanates from the secondary enclosure.

In a preferred embodiment, the primary enclosure comprises a plurality of primary enclosure walls and the primary enclosure is positioned within the secondary enclosure such that the plurality of primary enclosure walls are substantially parallel to the plurality of secondary enclosure walls.

Typically, sound emanates from the sound enhancement towards a listener. Preferably, the method for enhancing sound is carried out with the sound enhancement system described above. Most preferably, the method for enhancing sound is carried out with the sound enhancement system described above including the sound enhancement enclosure described above.

In one embodiment, the method further comprises getting the secondary enclosure ready for transport by removing the loudspeaker system from the secondary enclosure and collapsing the secondary enclosure into a folded position. In another embodiment the secondary enclosure in a folded position is attached to the secondary enclosure. In another embodiment, the loudspeaker system is secured to the secondary enclosure after the loudspeaker system is placed inside the secondary enclosure.

The following examples describe and illustrate the methods and compositions of the invention. These examples are intended to be merely illustrative of the present invention, and not limiting thereof in either scope or spirit. Unless indicated otherwise, all percentages are by weight. Those skilled in the art will readily understand that variations of the materials, conditions, and processes described in these examples can be used.

EXAMPLE 1

Enhancement of Lower Frequencies by Sound Enhancement Mechanism of the Current Invention.

An analysis was performed to determine the enhancement of low-end sound obtained using the sound enhancement mechanism of the current invention. For the analysis, sound was generated using open-back combo systems, tone controls were set at neutral, and reverb was turned off. The combo systems used for the experiments were either a 15 W RMS Vox® Pathfinder guitar amplifier equipped with an 8" speaker, or an 18 W RMS Fender® Princeton Reverb guitar amplifier equipped with a 10" speaker.

Sound levels were measured using a manufacturer-calibrated digital sound level meter (Realistic® (Tandy Inc, Tex., 1991) (cat.no. #33-2055; accuracy ±2.0%). All measurements were done on a dB scale at the level of the patient's ear, using the A (500 Hz–10,000 Hz) and the C (32 Hz–10,000 Hz) weighted scales) with the sound level meter device positioned 1 m away and facing the amplifier.

An audio signal was generated and fed into the input of the combo amplifier and its output was adjusted to a typical playing sound level using a frequency of 600 Hz as a guide. The audio signal was generated by a Tenma audio generator (TENMA, model #72-505, Test Equipment, Springboro, Ohio). A sinusoidal waveform was used for all testing. Once adjusted, all measurements were performed without changing the output or any further adjustment of the audio generator-amplifier output.

All devices used for the analysis were either equipped with fresh power batteries or ac-wall powered. The measurements of the sound levels where first performed with the stand-alone amplifier and then repeated with the secondary enclosure of the current invention. All measurements were done in triplicates and the mean of the three was taken to plot the graphs presented in the figures.

Figure 10:
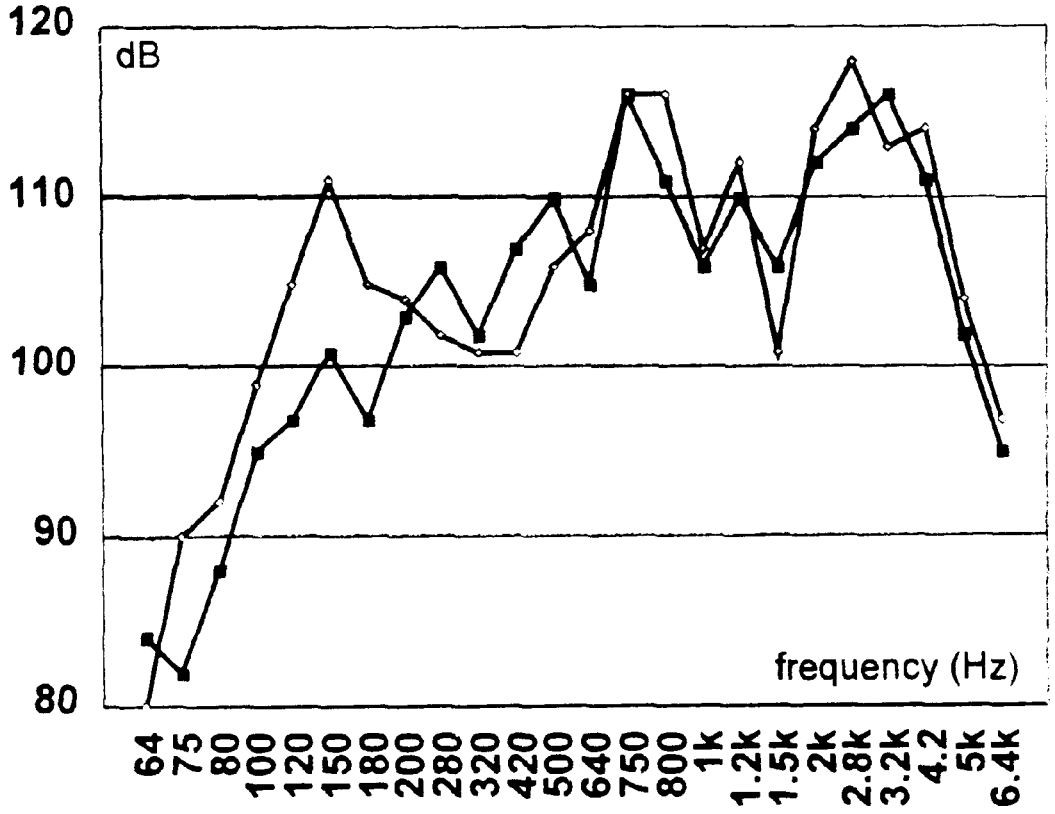
FIG. 10 is a graph comparing the frequency response of a typical commercially available guitar amplifier-speaker system (combo amplifier) equipped with an 8" speaker mounted in an open back enclosure. The data represents sound pressure levels of the combo amplifier with (empty squares) and without (filled squares) the secondary enclosure of the present invention, when amplified to typical playing volumes in a 90 m cubic room. The amplifier used for this test was a 15 W RMS Vox® Pathfinder guitar with tone controls set at neutral. For a person of normal hearing, a change in sound pressure level of 10 dB is perceived as being twice as loud as the original sound.
Figure 11:
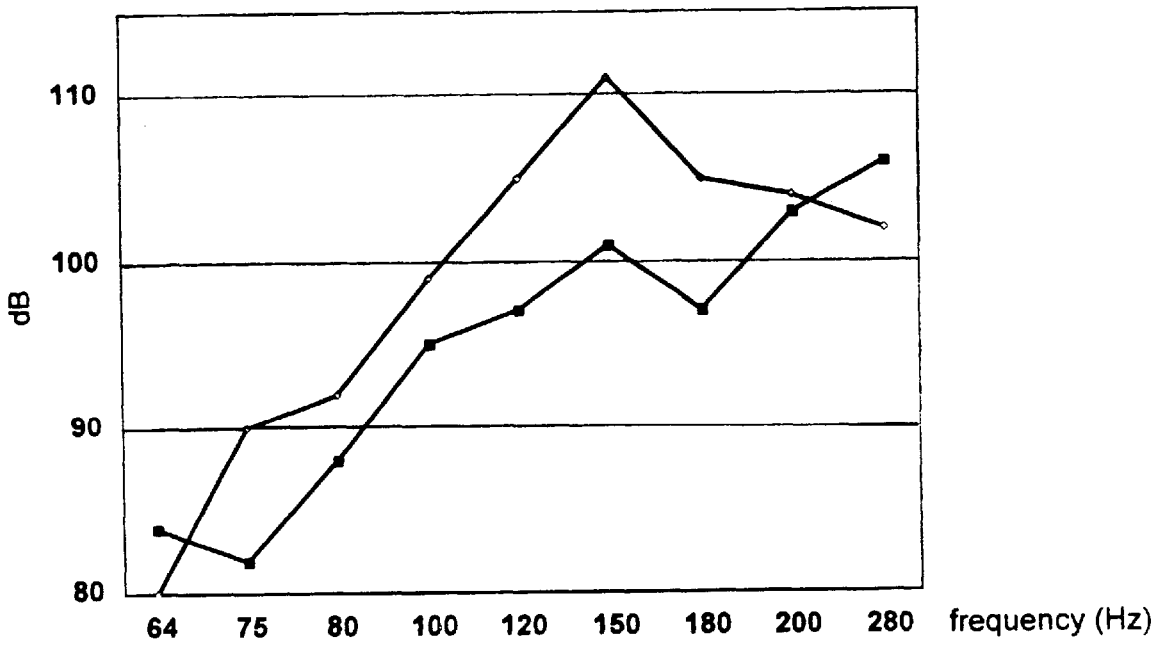
FIG. 11 is a graph focusing on the low-end frequency results presented in FIG. 10. The data represents sound pressure levels of the combo amplifier with (empty squares) and without (filled squares) the secondary enclosure of the present invention, when amplified to typical playing volumes in a 90 m cubic room. The amplifier used for this test was a 15 W RMS Vox® Pathfinder guitar with tone controls set at neutral. For a person of normal hearing, a change in sound pressure level of 10 dB is perceived as being twice as loud as the original sound.

Low-end response was enhanced by the secondary enclosure of the current invention in an indoor setting. As shown in FIGS. 10 and 11, sound pressure responses increased for frequencies in the 25 to 200 Hz range for sound amplified by a combo amplifier inside a room. In fact, sound generated at 150 Hz would be perceived as about twice as loud with the enclosure of the current invention for a person of normal hearing, since a change in sound pressure level of 10 dB is perceived as being about twice as loud as the original sound. The amplifier used for this test was an open-back combo amp, a 15 W RMS Vox® Pathfinder guitar, with tone controls set at neutral.

Figure 12:
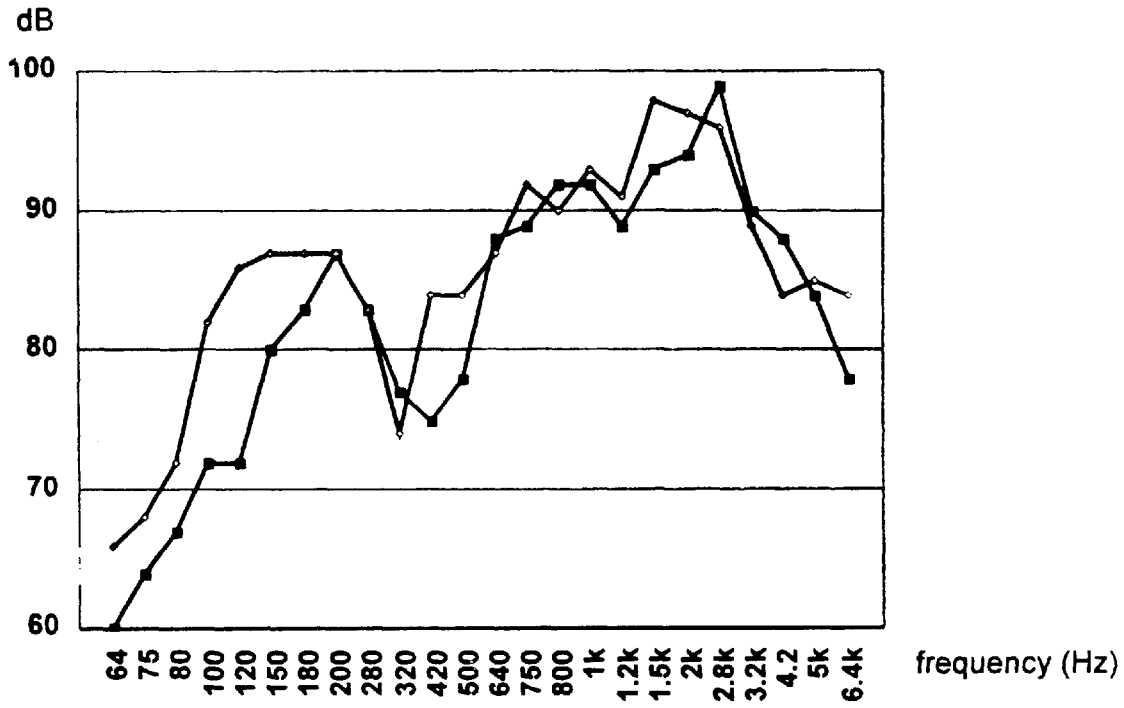
FIG. 12 is a graph comparing the frequency response of a typical commercially available guitar amplifier-speaker system (combo amplifier) equipped with 8" speaker mounted in an open back enclosure. The graphs represent sound pressure levels of the combo amplifier with (empty squares) and without (filled squares) the secondary enclosure of the current invention when amplified to typical playing volumes in an anechoic room (outdoors). The amplifier used for this test was a 15 W RMS Vox® Pathfinder guitar amplifier with tone controls set at neutral.
Figure 13:
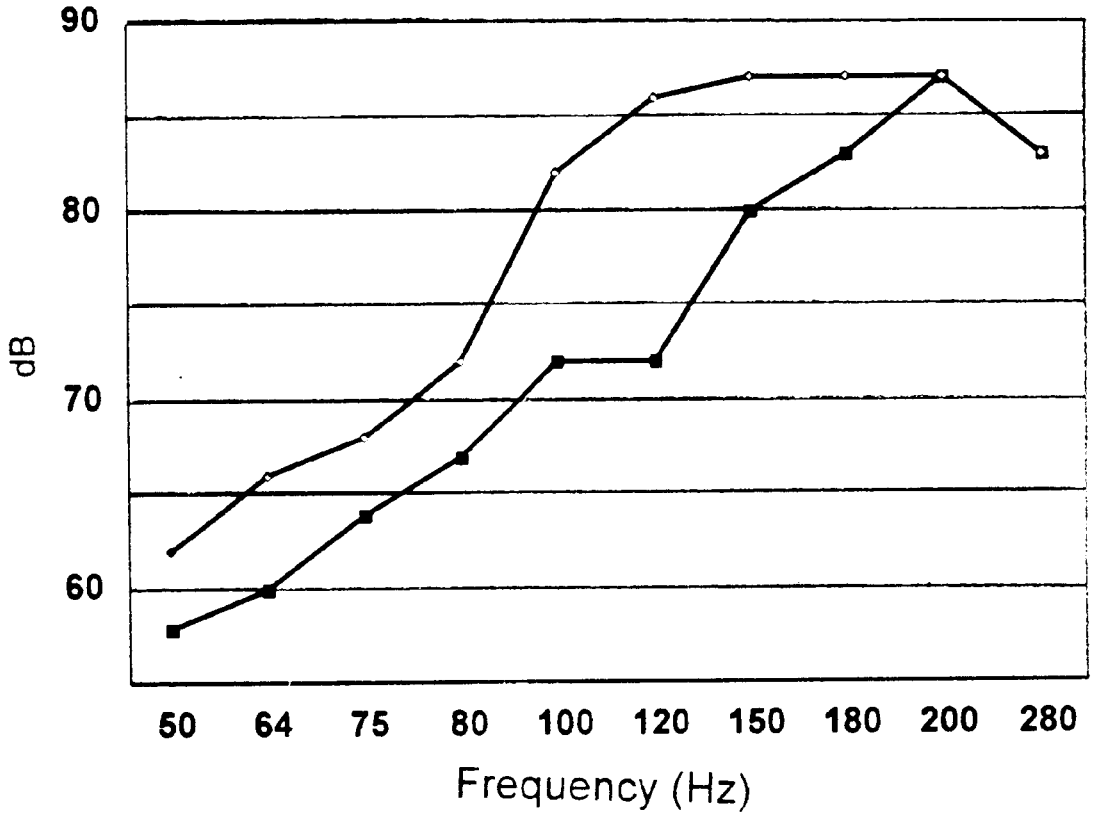
FIG. 13 is a graph focusing on the low-end frequency results graphed in FIG. 12. The graphs represent sound pressure levels of the combo amplifier with (empty squares) and without (filled squares) the secondary enclosure of the current invention when amplified to typical playing volumes in an anechoic room (outdoors). The amplifier used for this test was a 15 W RMS Vox® Pathfinder guitar amplifier with tone controls set at Neutral.
Figure 14:
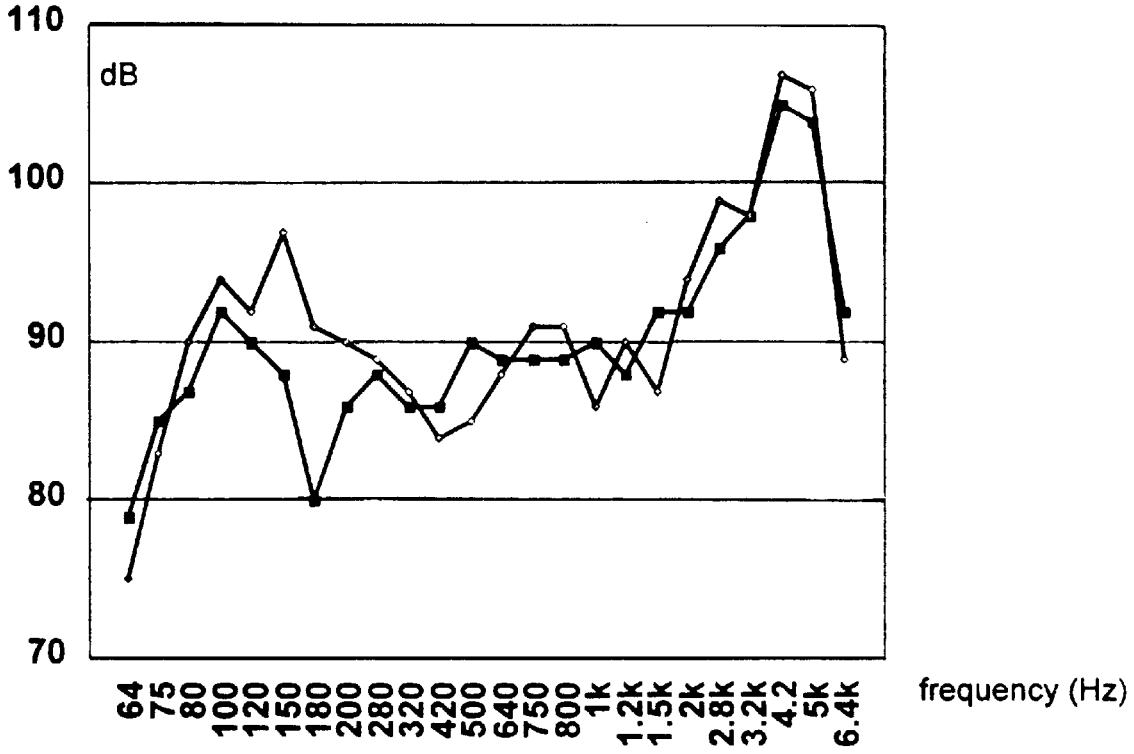
FIG. 14 is a graph comparing the frequency response of a typical commercially available guitar amplifier-speaker system (combo amplifier) equipped with a 10" speaker mounted in an open back enclosure. The graphs represent sound pressure levels of the combo amplifier with (empty squares) and without (filled squares) the secondary enclosure of the current invention when amplified to typical playing volumes in an averaged sized room. The amplifier used for this test was an 18 W RMS Fender® Princeton Reverb guitar amplifier with tone controls set at neutral and reverb off. For a person of normal hearing, a change in sound pressure level of 10 dB is perceived as being twice as loud as the original sound.

In addition to the enhanced response in an indoor setting, low-end response was enhanced by the secondary enclosure of the current invention in an outdoor setting. As shown in FIGS. 12 and 13, sound pressure responses increased for frequencies in the 25 to 200 Hz range for sound amplified by a combo amplifier located in an outdoor setting. In fact, sound generated at 120 Hz would be perceived as about twice as loud with the enclosure of the current invention for a person of normal hearing, since a change in sound pressure level of 10 dB is perceived as being about twice as loud as the original sound. As in the indoor experiment, the amplifier used for this test was an open-back combo amp, a 15 W RMS Vox® Pathfinder guitar, with tone controls set at neutral.

Figure 15:
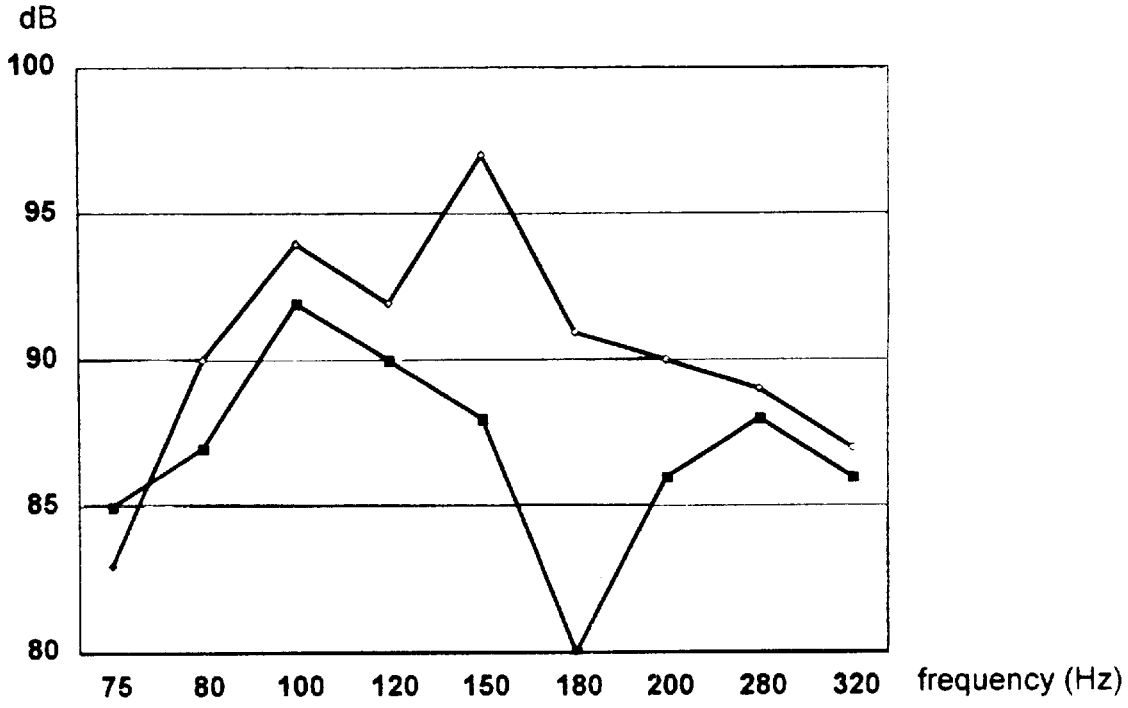
FIG. 15 is a graph focusing on the low-end frequency results presented in FIG. 14. The graphs represent sound pressure levels of the combo amplifier with (empty squares) and without (filled squares) the secondary enclosure of the current invention when amplified to typical playing volumes in an averaged sized room. The amplifier used for this test was an 18 W RMS Fender® Princeton Reverb guitar amplifier with tone controls set at neutral and reverb off. For a person of normal hearing, a change in sound pressure level of 10 dB is perceived as being twice as loud as the original sound.

In addition to the enhanced low-end response of the RMS Vox® Pathfinder guitar amplifier, the secondary enclosure of the current invention enhanced the low-end response of the 18 W RMS Fender® Princeton Reverb guitar amplifier, as well. As shown in FIGS. 15 and 16, when sound was amplified by this amplifier, the sound had increased responses in the 80 to 320 Hz range when the secondary enclosure of the current invention was used. While the invention has been described with reference to specific preferred embodiments, the invention is not limited to those precise embodiments. Rather, many modifications and variations will become apparent to persons of skill in the art without departure from the scope and spirit of this invention, as defined in the appended claims.

What is claimed is:

1. A sound enhancement system comprising:

a loudspeaker including a primary enclosure that contains a speaker from which sound having a predetermined quality emanates, the primary enclosure including a rear wall, lateral side walls and a top wall, with the side walls and top wall connected to the rear wall for enclosing the speaker;

a secondary enclosure having a rear wall, lateral side walls and a top wall, with the side walls and top wall interconnected to the rear wall to define an internal space; and hinges between the secondary enclosure side walls, top wall and rear wall, to provide the secondary enclosure with:

(1) an operative open position, with the primary enclosure freely positioned in the secondary enclosure to allow the corresponding walls of the enclosures to be variably spaced, the spacing between the top wall of the primary enclosure and the top wall of the secondary enclosure being approximately one to two feet, the spacing between the rear wall of the primary enclosure and the rear wall of the secondary enclosure being approximately one to two feet, and the spacing between at least one of the side walls of the primary enclosure and the adjacent wall of the secondary enclosure being approximately one to two feet, to change the predetermined sound quality emanating from the speaker; and (2) a collapsed position, with the secondary enclosure side and top walls stacked onto the rear wall.

2. The sound enhancement system according to claim 1, wherein the quality is fullness of the sound.

3. The sound enhancement system according to claim 1, wherein the quality is lower-end response.

4. The sound enhancement system according to claim 1, wherein the preexisting loudspeaker system is a combo amplifier-speaker system.

5. The sound enhancement system according to claim 1, wherein the secondary enclosure further comprises a redirection panel, wherein the redirection panel is effective for directing sound traveling in a direction out of the secondary enclosure.

6. The sound enhancement system of claim 1, wherein the secondary enclosure in the collapsed position attaches to the speaker system.

* * * * *